US006446399B1

(12) United States Patent
Lecours

(10) Patent No.: US 6,446,399 B1
(45) Date of Patent: Sep. 10, 2002

(54) PRE-FABRICATED CURVED-PROFILE ARCHITECTURAL ELEMENT AND METHOD FOR PRE-FABRICATING THIS ELEMENT

(76) Inventor: Yves Lecours, 2350, rue Yearling, Saint-Lazars, Quebec (CA), J7T 2F3

( * ) Notice: Subject to any disclaimer, the term of this patent is extended or adjusted under 35 U.S.C. 154(b) by 0 days.

(21) Appl. No.: 09/714,203

(22) Filed: Nov. 17, 2000

(30) Foreign Application Priority Data

Nov. 18, 1999 (CA) ..... 2290791

(51) Int. Cl.[7] ..... E04B 7/10
(52) U.S. Cl. ..... 52/81.2; 52/273; 52/287.1
(58) Field of Search ..... 52/631, 57, 81.2, 52/273, 287.1, 800.1, 800.11, 712.01, 718.01

(56) References Cited

U.S. PATENT DOCUMENTS 3,008,273 A * 11/1961 Widin
3,440,790 A * 4/1969 Nerem
3,934,385 A * 1/1976 Paulus et al. ..... 52/717
4,083,153 A 4/1978 Sumpter ..... 52/28
4,835,921 A 6/1989 Baggett, Jr. et al. ..... 52/220
5,321,921 A * 6/1994 Holt ..... 52/97
5,507,123 A * 4/1996 Holt ..... 52/97
5,590,493 A * 1/1997 Wilson ..... 52/108
5,655,345 A 8/1997 Thompson ..... 52/396.1
5,671,583 A 9/1997 Turner ..... 52/745.16

* cited by examiner

*Primary Examiner*—Carl D. Friedman
*Assistant Examiner*—Brian E. Glessner
(74) *Attorney, Agent, or Firm*—Goudreau Gage Dubuc

(57) ABSTRACT

A pre-fabricated architectural element has a curved profile and has at least one curved brace member. A bendable panel is applied to the curved brace member, bent on this brace member to form the panel with the curved profile, and fastened to the curved brace member. Finally, the pre-fabricated architectural element comprises a uniform, smooth and regular surface finish on an outer face of the panel opposite to the curved brace member. A method of pre-fabricating this curved-profile architectural element comprises providing at least one curved brace member, providing a bendable panel, and applying the panel to the brace member. Application of the panel to the brace member comprises forming the panel with the curved profile by bending this panel on the brace member, and fastening the panel to the brace member. To complete the method, an outer face of the panel, opposite to the brace member, is finished in a uniform, smooth and regular surface. Preferably, the panel is a generally rigid panel in which laterally adjacent and parallel grooves are cut. Also, the outer face of the panel is finished by applying tape and drywall compound. Advantageously, the panel is applied to a plurality of curved brace members appropriately spaced apart from each other.

10 Claims, 6 Drawing Sheets

PRE-FABRICATED CURVED-PROFILE ARCHITECTURAL ELEMENT AND METHOD FOR PRE-FABRICATING THIS ELEMENT

BACKGROUND OF THE INVENTION

1. Field of the Invention

The present invention relates to pre-fabricated architectural elements presenting a curved profile, and to a method of pre-fabricating such architectural elements.

2. Brief Description of the Prior Art

The application of gypsum panels to a wood or metal structure (drywalls) is currently the mostly used method for erection of interior walls and ceilings in buildings. However, although rigid gypsum drywall panels provide a fast and economical solution to basic architecture requirements, they introduce important limitations with regard to the construction of curved surfaces.

According to a common practice, curved profiles of a radius larger than about 18 inches are made by laying a gypsum panel horizontally and wetting it with water to make it bendable, prior to installation on an appropriate wall or ceiling structure. That method is very difficult to use with success and only applies to very large diameters. Too much water or insufficient wetting for given atmospheric conditions lead to panel destruction.

Another method is known by specialised professionals to built curved sections in drywalls, which applies to small as well as large diameters. That prior art technique first consists of preparing and installing an appropriate wood or metal structure where the wall or ceiling curved portion is to be erected. In a second operation, gypsum panels are cut to size and grooves are then cut on one side of the gypsum panel, with appropriate spacing therebetween, in the longitudinal axis of the curved profile to be made. The grooves are cut manually using a gypsum panel knife. Thirdly, the piece of gypsum panel is bent in order to break along each score line while preserving the integrity of the paper layer on the non-grooved side and is then screwed on the wood or metal structure frame to form the curved shaped wall or ceiling section. It should be mentioned that since the grooved piece of gypsum panel can only be bent in one direction to form a curved profile, concave wall sections expose the non-grooved paper side while the visible side of convex wall sections show the grooves opened into a V shape. Finally, the visible face of the wall must be finished by applying paper tape and drywall compound, drying and sanding, repeating some of the operations until a satisfactory finish is obtained. The surface can then be painted.

Obviously, finishing a curved surface of a vertical wall or ceiling is a complex and labour intensive task mainly due to the thickness of compound to be applied for example in the wide and deep V grooves encountered on convex surfaces while the gravity is acting adversely. Therefore, the erection of curved wall or ceiling surfaces is currently a complex, labour intensive, time-consuming and costly operation and is only seldom used, thus limiting the spectrum of architectural variations in building construction. Self-standing architectural elements such as decorative columns also present interest in construction but remain very expensive items. Indeed, such elements are currently machined and assembled from wood, metal, polystyrene foam etc. and sold for hundreds of dollars a piece. Although gypsum panels and drywall compound are cheap materials, the prior art does not provide any solution for fabricating at low cost architectural elements such as curved cross-section columns using these materials.

There is thus a need for pre-fabricated architectural elements with a curved profile that would permit rapid construction of curved wall or ceiling surfaces or columns in an easy and economical manner, while preserving the finish quality of ordinary flat drywall surfaces.

SUMMARY OF THE INVENTION

To overcome the limitations and drawbacks of the prior art, the present invention provides a method of pre-fabricating an architectural element presenting a curved profile, comprising:

- providing at least one curved brace member;
- providing a bendable panel;
- applying the panel to the brace member, wherein application of the panel to the brace member comprises:
  - forming the panel with the curved profile by bending this panel on the brace member; and
  - fastening the panel to the brace member; and
- finishing an outer face of the panel, opposite to the brace member, in a uniform, smooth and regular surface.

According to preferred embodiments of the method of pre-fabricating an architectural element:

- providing a bendable panel comprises scoring a generally rigid panel thus making the generally rigid panel bendable;
- scoring a generally rigid panel comprises scoring a gypsum drywall panel;
- the method of pre-fabricating an architectural element further comprises forming at least one mounting flange in the panel;
- scoring a generally rigid panel comprises cutting in this generally rigid panel a plurality of laterally adjacent and parallel score lines, more specifically cutting in the generally rigid panel a plurality of laterally adjacent and parallel grooves;
- providing at least one curved brace member comprises producing a plurality of curved brace members, and applying the panel to these brace members comprises: removably installing with a proper spacing between them the brace members on a supporting jig; forming the panel with the curved profile by bending this panel on the brace members; and fastening the panel to those brace members;
- finishing an outer face of the panel in a uniform, smooth and regular surface comprises applying a drywall compound, and eventually tape to the outer face of the panel, drying the drywall compound with the panel in a generally horizontal position, and applying a sealing compound to the finished outer face;
- the method of pre-fabricating an architectural element further comprises installing corner protecting devices on corners of the architectural element for protection of the architectural element during transportation and storage thereof; and
- providing at least one brace member comprises providing at least one convex and/or concave brace member.

The present invention further relates to a prefabricated architectural element presenting a curved profile, comprising at least one curved brace member, a bendable panel applied to the curved brace member, bent on the curved brace member to form the panel with the curved profile, and fastened to this curved brace member, and a uniform, smooth and regular surface finish on an outer face of the panel opposite to the brace member.

According to preferred embodiments of the pre-fabricated architectural element:

the bendable panel is a scored, generally rigid panel;

the scored, generally rigid panel is a gypsum drywall panel;

the surface finish comprises a drywall compound and eventually tape;

the scored, generally rigid panel comprises a plurality of laterally adjacent and parallel score lines, more specifically a plurality of laterally adjacent, parallel grooves;

it comprises a plurality of curved brace members spaced apart from each other, and the bendable panel is applied to the brace members, bent on the brace members to form the panel with the curved profile, and fastened to these brace members;

the surface finish comprises a sealing compound;

the curved brace member(s) and the curved profile are convex and/or concave; and the pre-fabricated architectural element further comprises at least one mounting flange made in the panel.

The above as well as other objects, advantages and features of the present invention will become more apparent upon reading of the following non restrictive description of preferred embodiments thereof, given for the purpose of illustration only with reference to the accompanying drawings.

DETAILED DESCRIPTION OF THE PREFERRED EMBODIMENTS

Figure 1:
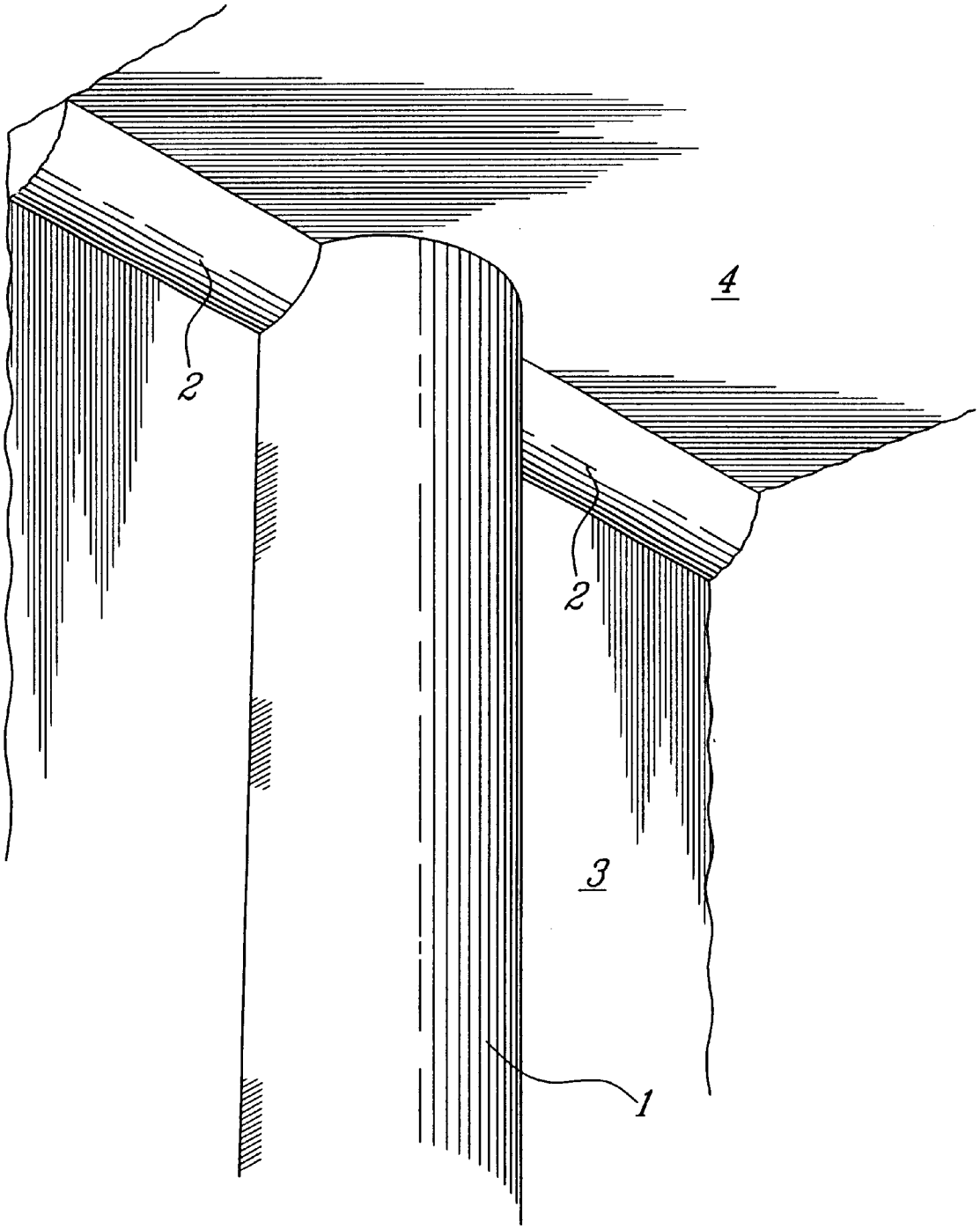
FIG. 1 is a perspective view of an architectural structure incorporating pre-fabricated curved-profile elements according to the present invention.

Similar reference numerals refer to similar parts throughout the various figures of the appended drawings.

Preferred embodiments of the pre-fabricated curved-profile architectural element and method for the factory production of these pre-fabricated curved-profile architectural elements according to the present invention will now be described in detail with reference to the appended drawings.

Referring to FIG. 1, there is illustrated an example of an architectural structure incorporating pre-fabricated curved-profile elements made in accordance with the present invention. The illustrated structure incorporates a semi-circular profile and vertically installed architectural element 1 simulating a column applied to a vertical wall surface 3, and a quarter-round profile element 2 horizontally installed at the intersection of the vertical wall surface 3 and an horizontal ceiling surface 4. A wide variety of such architectural structures can obviously be made easily, rapidly and economically using different pre-fabricated curved profile architectural elements in different arrangements. The pre-fabricated elements are merely formed of a bendable panel formed on and fastened to a brace structure. They also require finishing steps, i.e. filling of screw holes, jointing between elements, reinforcing comer edges and application of sealer/primer and paint.

Figure 2:
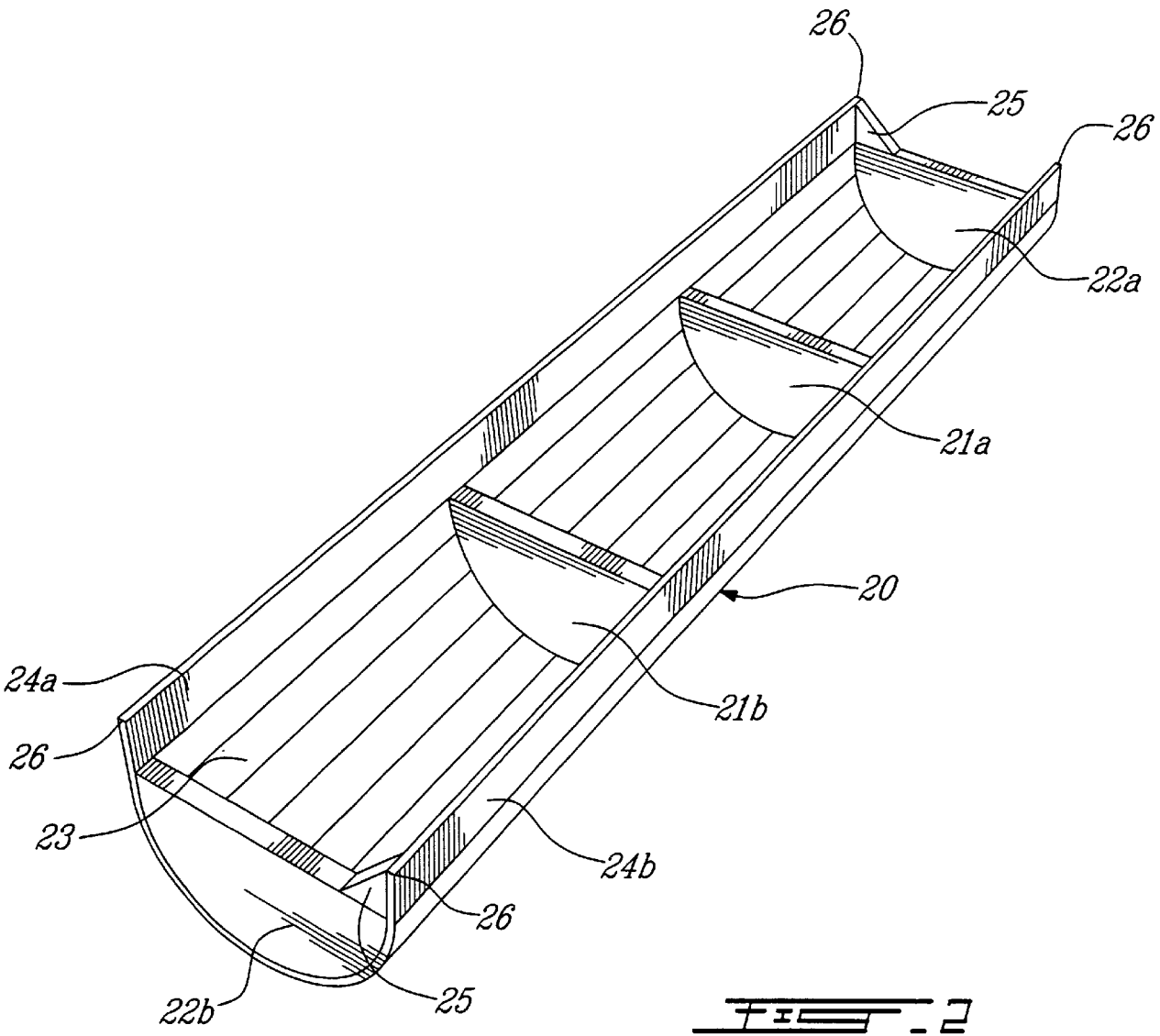
FIG. 2 is a perspective view of the inside of a pre-fabricated curved-profile element according to the present invention.

FIG. 2 shows the inside of a typical pre-fabricated curved-profile architectural element 20 provided with a semi-circular convex cross-section. The element 20 is basically made from a bent, scored gypsum drywall panel 23 assembled on end brace members 22*a* and 22*b*, and intermediate brace members 21*a* and 21*b*. Mounting flanges 24*a* and 24*b* are also made in the panel 23 to enable easy assembly of the element 20 on wood or metal studs using, for example, ordinary gypsum screws. The corners such as 26 of the mounting flanges 24*a* and 24*b* may be protected against damages during handling, transportation and storage by removable brace members such as 25 or caps (not shown) made of wood or cardboard. As better seen in FIGS. 5*a*, 5*b*, 5*c*, 6 and 7, the scored gypsum panel 23 is fastened to the brace members using adhesive or fasteners 57, such as staples, screws or nails, and its external face is coated with drywall compound (such as 53 in the example of FIG. 5*a*) and reinforced with radial paper tape bands (such as 52 in FIG. 5*a*) to provide a smooth, uniform and regular finish. Optionally, a sealer may be applied to the external surface of the element to provide further protection against erosion as well as a base surface appropriate for application of paint. As shown in FIGS. 5*a*, 5*b*, 5*c*, 6*a*, 6*b* and 7, the architectural elements of the present invention may form different curved profiles of either convex, concave or combined convex/concave shape.

Just a word to mention that it is within the scope of the present invention to use panels other than gypsum drywall panels suitable for that purpose, such panels requiring or not score lines or grooves to make them bendable. Other type of finishing technique or material can also be contemplated. Moreover, the term "panel" is intended to designate panels and panel portions of any size and dimensions.

Figure 4A:
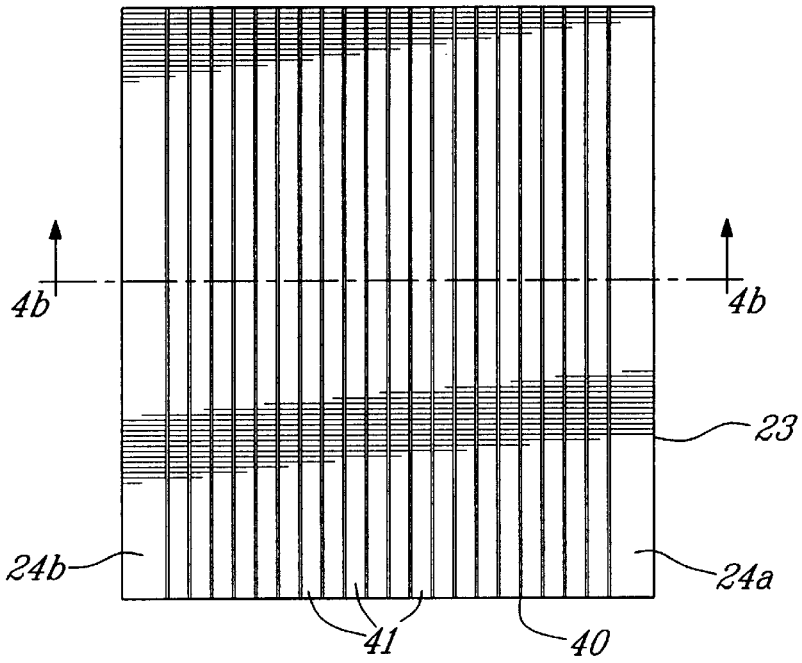
FIG. 4*a* is a top plan view of a panel in which a set of parallel and laterally adjacent grooves have been cut in view of pre-fabricating a curved-profile element according to the present invention.
Figure 4B:
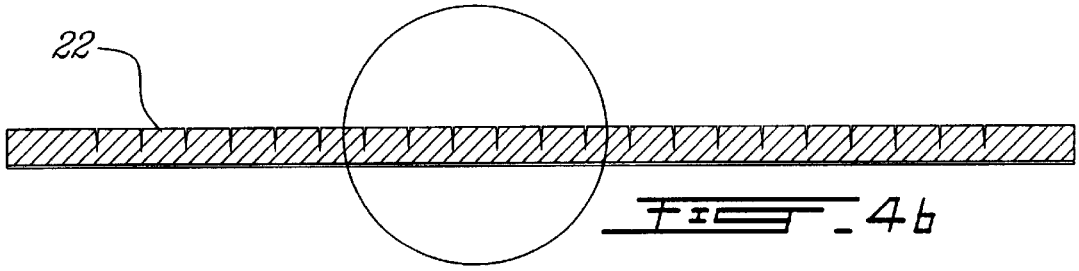
FIG. 4*b* is a cross-sectional view of the grooved panel of FIG. 4*a* taken along line 4*b*—4*b;*
Figure 4C:
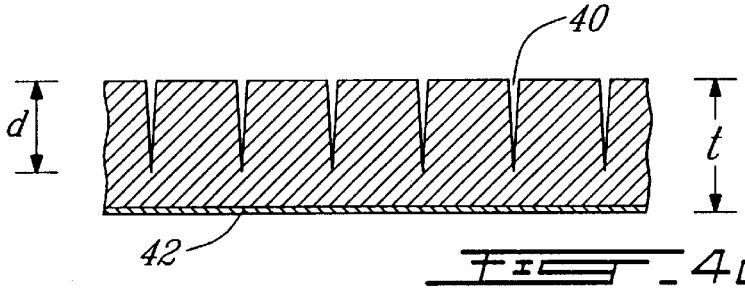
FIG. 4*c* is an enlarged cross-sectional view of a portion of the grooved panel of FIG. 4*b;*
Figure 4D:
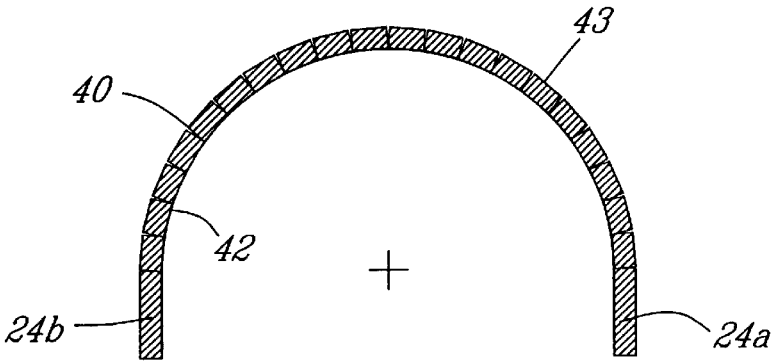
FIG. 4*d* is a cross-sectional view of the grooved panel of FIG. 4*a* after bending to form a polygonal shape.

The generally rigid gypsum drywall panel 23 (FIG. 2) is made bendable by cutting laterally adjacent and parallel grooves 40 (FIG. 4) on one face thereof, in the axial direction of the architectural element 20 to be fabricated. Basically, since gypsum is a very brittle material, grooves of depth d (FIG. 4*c*) of about ⅔ of the panel thickness t will enable breakage of the panel 23 about each groove by bending the panel as shown in FIG. 4*d* (see 43). A set of laterally adjacent and parallel panel sections such as 41 connected to each other through one of the paper layers 42 is thereby produced.

Figure 3A:
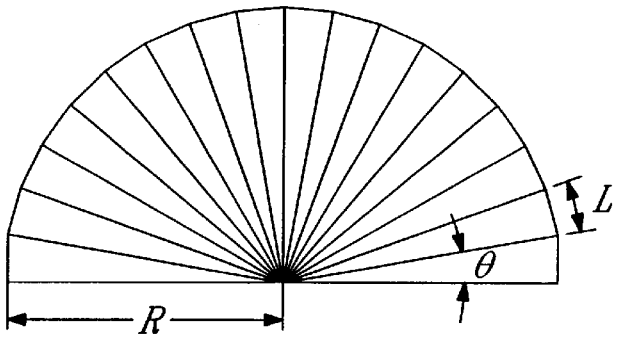
FIG. 3*a* represents a polygonal shape to be obtained from a panel during pre-fabrication of a curved-profile element according to the present invention.

Referring to FIG. 3*a*, it can be seen that the relative angular positions 41 of the panel sections can be set to constitute a polygonal profile. To make smooth curves of a given radius R, experience has shown that the base polygonal shape shall be formed with fold angles θ of less than 10 degrees. Since the length of an arc of radius R over a 10 degree angle is given by $I=\pi R/18$, the spacing L between adjacent grooves 40 shall be set to a value smaller than about R/6, and will be rarely set to a value lower than R/9 (6.3 degrees). For example, to make a circular column of 12 inches in diameter, the spacing L between grooves shall advantageously be set to a value equal to or lower than 1 inch.

Figure 3B:
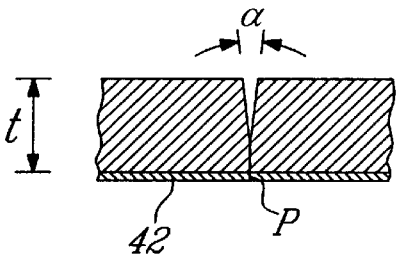
FIG. 3*b* is a cross-sectional view of a narrow groove cut in a panel to make that panel bendable.
Figure 3C:
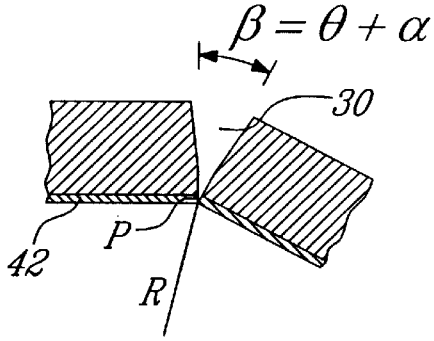
FIG. 3*c* is a cross-sectional view of the scored panel of FIG. 3*b* once bent in the direction of the non-scored face.

FIG. 3*b* shows a groove cut into a gypsum drywall panel 23 with the blade of a drywall knife. That type of groove is in the shape of a narrow triangle with an apex angle of α degrees and has a depth of 2t/3 as previously stated, t being the thickness of the gypsum drywall panel. When the gypsum panel is bent about axis p in the direction of the non-grooved face as shown in FIG. 3*c*, to form the polygon of FIG. 3*a*, a triangular prismatic cavity 30 of apex angle $\beta=\alpha+\theta$ is created. The panel sections 41 are only connected to each other by the lower paper layer 42. Therefore, when that bending technique is used, these cavities 30 must be filled with finishing drywall compound.

Figure 3D:
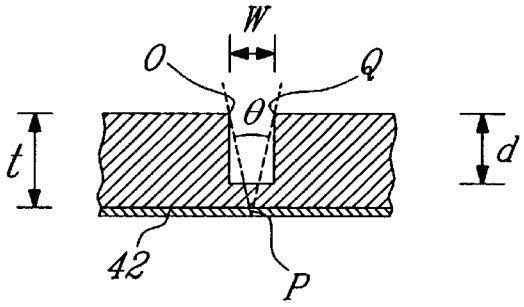
FIG. 3*d* is a cross-sectional view of a wide rectangular groove cut in a panel to make that panel bendable.
Figure 3E:
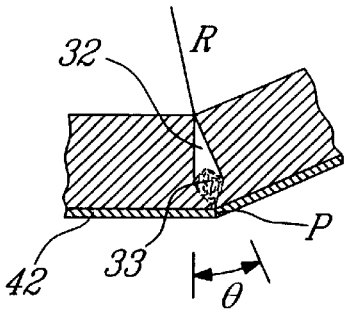
FIG. 3*e* is a cross-sectional view of the scored panel of FIG. 3*d* once bent in the direction of the scored face.

A second folding technique is illustrated in FIGS. 3*d* and 3*e* where relatively wide rectangular grooves are cut into the gypsum drywall panel 23. With that technique, the panel can be bent in the direction of the grooved face as shown in FIG. 3*c* if the following conditions are respected. Otherwise, a rectangular groove will still permit bending in the direction of the non-grooved face. The depth d is such that only about 0.060 to 0.080 inch of material is left from the total thickness t. The width of the groove is set to form the folding angle θ (FIG. 3*d*) as the apex angle of the triangle formed by folding point p and the top edges of the groove O and Q. Minimum groove width W is thus given by $W=2t\tan(\theta/2)$. Therefore, a ⅛ inch wide blade, such as a rotary saw blade, will cut grooves permitting folding to a maximum of about 10 degrees, which satisfies most applications. After bending, a prismatic inner cavity 32 is formed in which the gypsum material 33 left at the base of the groove is compressed. The weakness of the gypsum material is such that at the specified thickness, it is compressed without affecting the integrity of the outer paper layer 42 along folding line p.

Figure 3F:
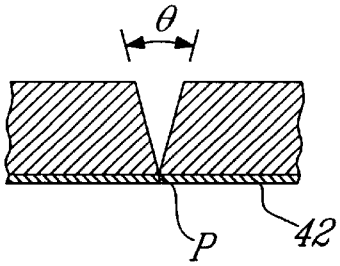
FIG. 3*f* is a cross-sectional view of a wide triangular groove cut in a panel to make that panel bendable.
Figure 3G:
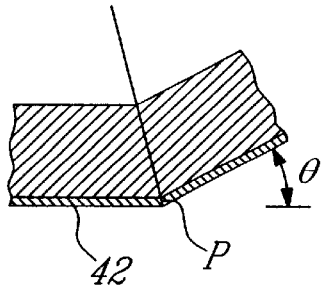
FIG. 3*g* is a cross-sectional view of the scored panel of FIG. 3*f* once bent in the direction of the scored face.

Referring to FIGS. 3*f* and 3*g*, a similar process can be carried out with a wide V-shaped groove of apex angle greater or equal to the folding angle θ. With the appropriate angle and a depth of the groove almost reaching the paper layer 42, a neat folding line is obtained since the formation of broken gypsum particles can be almost totally avoided.

It can then be understood that different bending techniques can be used to obtain convex, concave, or combined convex/concave shapes with the grooves appearing on the inner and/or outer faces of the non-finished architectural element. Examples are illustrated in FIGS. 5*a*, 5*b*, 6*a*, 6*b* and 7.

Figure 5B:
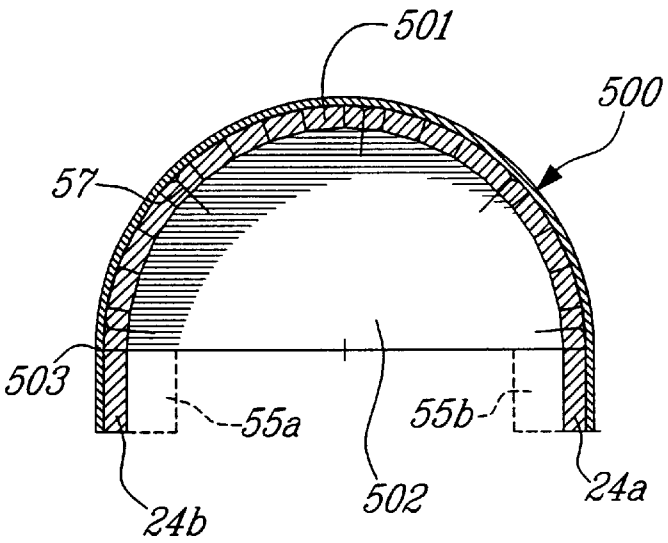
FIG. 5*b* is a cross-sectional view of a finished convex architectural element pre-fabricated according to the present invention and made from a panel bent in the direction of its scored face.
Figure 5A:
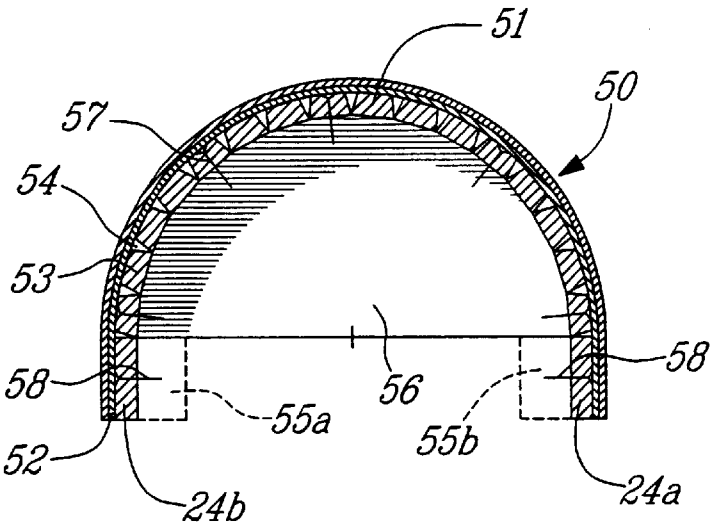
FIG. 5*a* is a cross-sectional view of a finished convex architectural element pre-fabricated according to the present invention and made from a panel bent in the direction of its non-scored face.

FIG. 5*a* shows a pre-fabricated convex-profile architectural element 50 destined to be installed with drywall screws 58 on mounting studs 55*a* and 55*b* at the project site. To pre-fabricate architectural element 50 a drywall gypsum panel is cut to the appropriate size and scored with a narrow blade to generate a minimum of dust and produce cavities (grooves) 54 as small as possible since the panel will be bent in the direction of its non-scored face, making the cavities 54 visible on the outer face of the unfinished element. The resulting scored panel 51 is then applied to and formed with the curved profile by bending on transversal brace members 56 placed with a spacing of 12 to 24 inches between each other along the element 50. The brace members 56 are preferably made of wood, although plastic, cardboard, metal or other suitable material could be used. The gypsum drywall panel 51 is preferably fastened with staples 57 to the bracing members 56 to speed-up the operation and for economy, but nails, screws, adhesive or any combinations thereof could be used as well. Cavities 54 are then filled with drywall compound and paper tape 52 is applied transversely of the cavities (grooves) 54 and the longitudinal axis of the architectural element, with a spacing of about 16 inches. Filling of the cavities 54 provides compression strength to the element 50 to resist against outward flexion strain, while the strips of paper tape 52 provide tensile strength to resist to inward flexion strain. Paper tape 52 can be replaced by any other suitable flexible thin reinforcement such as a grid web currently used to reinforce gypsum drywall surfaces. A finishing coat of drywall compound 53 is finally applied to the outer face to provide a smooth, uniform and regular finish surface, thus completing the pre-fabricated convex-profile architectural element 50. Some wet or dry abrasion may be required after drying to obtain the desired finish softness. The finished surface may then be optionally coated with a sealer compound for protection.

FIG. 5*b* shows an alternative embodiment for the structure of a pre-fabricated convex-profile architectural element 500. Wide laterally adjacent and parallel rectangular or V-shaped grooves (see FIG. 3*f*) are cut in the gypsum drywall panel 501 and this panel is formed with a semi-circular profile by bending it in the direction of its scored face on the brace members 502 as described above. Finally, panel 501 is fastened to the brace members 502 also as described hereinabove. That technique prevents the presence of cavities on the outer face and therefore only requires application of a finishing coat of drywall compound 503 to provide a smooth, uniform and regular semi-circular surface. Although the architectural element so fabricated is cheaper to manufacture, it has significantly lower mechanical and structural resistance since the inner face is left with unfilled exposed cavities such that the wall thickness at groove locations is only equal to the thickness of the paper layer of the gypsum panel plus the thickness of the compound coating.

Figure 6B:
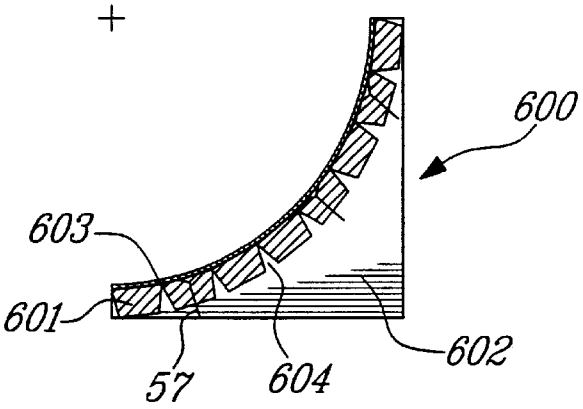
FIG. 6*b* is a cross-sectional view of a finished concave architectural element pre-fabricated in accordance with the present invention and made from a panel bent in the direction of its non-scored face.
Figure 6A:
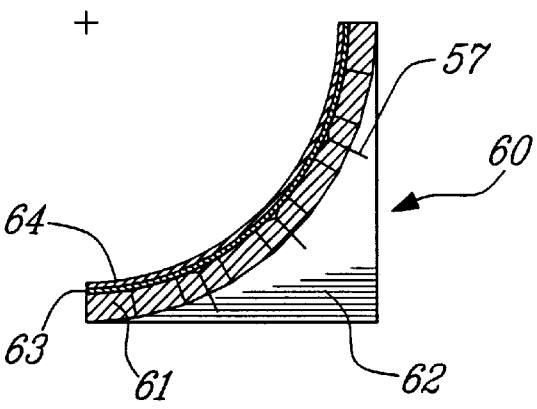
FIG. 6*a* is a cross-sectional view of a finished concave architectural element pre-fabricated in accordance with the present invention and made from a panel bent in the direction of its scored face.

FIGS. 6*a* and 6*b* represent quarter-round concave prefabricated architectural elements 60 and 600. The element 60 of FIG. 6*a* has been obtained from a panel 61 bent in the direction of parallel and laterally adjacent rectangular or V-shaped grooves, and finished in the same way as element 50 of FIG. 5*a*. The panel 61 is bent, formed and fastened with staples 57 on brace members 62 and covered with paper tape strips 63 transversely of the grooves and a finishing coating of drywall compound 64. That technique provides better mechanical and structural properties to the element as compared to the technique illustrated in FIG. 6*b*. Indeed, in that element 600, the internal face is left with unfilled exposed cavities 604 such that the wall thickness at groove locations is only equal to the thickness of the paper layer of the gypsum panel 601 plus the thickness of the compound coating 603. To obtain a reasonable mechanical resistance with such an arrangement, finishing of the back of the panel would be required in addition the finishing of the front face.

Therefore, for convex curves as for concave curves, a structure with outwardly oriented grooves is preferred for optimal resistance and economy.

Figure 7:
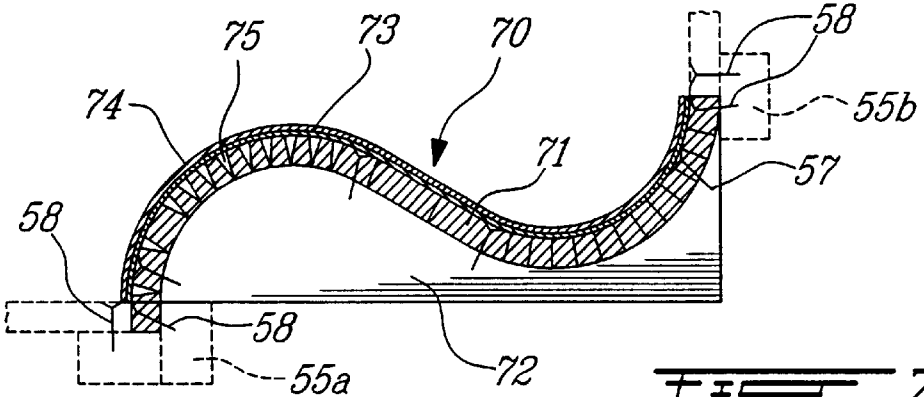
FIG. 7 is a cross-sectional view of a finished curved architectural element made from a panel and pre-fabricated in accordance with the present invention, the architectural element of FIG. 7 comprising both convex and concave surface portions and having an outwardly oriented scored panel face.

An example of an architectural element 70 combining concave and convex curvilinear sections is illustrated in FIG. 7. As stated above, all the grooves have been cut in the outer face of the gypsum panel 71. For practical considerations, all the grooves may be made with a similar cutting tool such as a ⅛ inch wide rotating blade. The cavities 75 are filled with drywall compound, paper tape bands 73 are applied transversally of the grooves on top and covered with a finishing coat of drywall compound or similar material 74. Obviously, that type of element could also be fabricated with inwardly oriented grooves of a combination of inwardly and outwardly oriented grooves, with or without some reinforcing finish applied to the inner face with less interesting results from an economic and/or structural point of view.

The prefabricated curved profile architectural element structures according to the present invention described above can be advantageously obtained by applying the following preferred method:

1. cut one or more drywall gypsum panels into sizes as required by the architectural elements to be prefabricated;
2. cut laterally adjacent and parallel grooves on one side of the gypsum panels with cross-sectional shape and depth appropriate to the curves to be shaped;
3. removably install brace members properly spaced apart on a supporting jig to define a generally horizontal element longitudinal axis;
4. form the panel by bending on the brace members and fasten on the brace members with the grooves facing outwardly;
5. fill cavities with drywall compound;
6. place paper tape strips transversally with respect to the grooves;
7. apply a finishing coating of drywall compound to obtain a smooth, uniform and regular curvilinear surface; and
8. remove the architectural element from the generally horizontal mounting jig and let dry in a generally horizontal position.

It shall be noted that a major advantage of pre-fabricating the structural elements according to the above method is that the element is assembled horizontally. Accordingly, even in a long element the drywall compound is adhering to the cavities and to the panel face under the effect of gravity, instead of downwardly slipping along the groove axis. The jig can even be rotated about the element longitudinal axis during the process to maintain an always optimal orientation.

Closed profiles, such as round columns, can be prefabricated using a central hole provided in the brace members for installation on a mounting jig comprising an elongated member inserted through all of the brace members as a shish-kebob.

The prefabrication method also permits the use of a manually or electronically programmable groove cutting table or conveyor to cut all the grooves to the appropriate depth and spacing in a single pass.

Custom shaping and/or drywall compound dispensing jigs can also be used to shape the external face of the element according to a standard pattern in a minimal number of passes.

Therefore, it can be seen that the pre-fabricated curved-profile architectural element and method for the factory production of pre-fabricated curved-profile architectural elements according to the present invention can be advantageously used to provide a wide variety of aesthetic yet economical architectural solutions for the construction market.

The pre-fabricated architectural elements presenting a curved profile, and the method of pre-fabricating these architectural elements presents, amongst others, the following advantages:

- the curved profile architectural elements enable economical construction of curved wall, ceiling or self-supporting elements;
- the pre-fabricated curved profile architectural elements can be made from low cost standard gypsum drywall panels;
- the pre-fabricated curved-profile architectural elements can be factory pre-fabricated and semi-finished and can be sold as standard items by lumber suppliers in a variety of popular or custom shapes and sizes;
- the pre-fabricated curved-profile architectural elements can be installed easily and rapidly on a construction site like flat gypsum drywall panels by ordinary skilled carpenters, thus also providing significant reduction in installation costs;
- the pre-fabricated curved-profile architectural elements feature high uniformity in shape and surface finish quality;
- the pre-fabricated curved-profile architectural elements speed-up the erection of curved wall and ceiling surfaces on construction sites;
- the pre-fabricated curved-profile architectural elements feature a usually higher rigidity and structural resistance than elements built on construction sites according to the methods of the prior art;
- the pre-fabricated curved-profile architectural elements can be factory shaped into the form of curved cross-section columns according to the method of the present invention;
- the curved profile architectural elements can be factory pre-fabricated in an efficient and flexible way in a wide variety of shapes and in small lot sizes; and
- the finishing steps can be made in a generally horizontal set-up, with positive or negligible impact of the gravity on the process.

Although the present invention has been described by means of preferred embodiments thereof, it is contemplated that various modifications may be made thereto without departing from the spirit and scope of the present invention. For example, the standard drywall compound could be substituted by a polymer based compound featuring higher structural and abrasion resistance, or a mixture incorporating Paris plaster to reduce or eliminate shrinkage and accelerate drying. Accordingly, it should be understood that the above described embodiments have been presented for the purpose of illustration only and that the scope of the present invention should not be limited thereto but be determined with reference to the claims hereinafter provided and their equivalents.

What is claimed is:

1. A pre-fabricated architectural element presenting a curved profile, comprising:

at least one curved brace member;

a bendable panel:

applied to said at least one curved brace member;

bent on said at least one curved brace member to form the panel with the curved profile; and fastened to said at least one curved brace member; and a uniform surface finish on an outer face of the panel opposite to said at least one brace member;

wherein the bendable panel is a scored gypsum drywall panel.

2. A pre-fabricated architectural element as defined in claim 1, wherein the surface finish comprises a drywall compound.

3. A pre-fabricated architectural element as defined in claim 1, wherein the surface finish comprises a flexible thin reinforcement and a drywall compound.

4. A pre-fabricated architectural element as defined in claim 1, wherein the scored gypsum drywall panel comprises a plurality of laterally adjacent and parallel score lines.

5. A pre-fabricated architectural element as defined in claim 4, wherein said plurality of laterally adjacent and parallel score lines comprise a plurality of laterally adjacent, parallel grooves.

6. A pre-fabricated architectural element as defined in claim 1, wherein:

said at least one curved brace member comprises a plurality of curved brace members spaced apart from each other; and the bendable panel is:

applied to the brace members;

bent on the brace members to form said panel with the curved profile; and fastened to said brace members.

7. A pre-fabricated architectural element as defined in claim 2, wherein the surface finish comprises a sealing compound.

8. A pre-fabricated architectural element as defined in claim 1, wherein both said at least one curved brace member and the curved profile are convex.

9. A pre-fabricated architectural element as defined in claim 1, wherein both said at least one curved brace member and the curved profile are concave.

10. A pre-fabricated architectural element as defined in claim 1, further comprising at least one mounting flange made in the panel.

* * * * *